United States Patent [19]

Duncan

[11] Patent Number: 5,025,508

[45] Date of Patent: Jun. 25, 1991

[54] SCARF CONSTRUCTION

[76] Inventor: Patty S. Duncan, 3575 Earhart Rd., Mt. Juliet, Tenn. 37122

[21] Appl. No.: 452,293

[22] Filed: Dec. 18, 1989

[51] Int. Cl.[5] ..... A42B 5/00

[52] U.S. Cl. ..... 2/207; D2/500; D2/501

[58] Field of Search ..... 2/129, 207, 131, 75, 2/80, 91, 199, 185 R; D2/500, 501, 502, 503, 504, 505, 506, 507, 508, 600, 602, 603, 604

[56] References Cited

U.S. PATENT DOCUMENTS

| | | | |
|---|---|---|---|
| D, 97,457 | 11/1935 | Bernstein et al. | D2/503 X |
| D. 121,135 | 6/1940 | Wittl | D2/500 |
| D. 308,763 | 6/1990 | Lesch | D2/500 X |
| D. 308,764 | 6/1990 | Lesch | D2/500 X |
| 968,199 | 8/1910 | Schwartz | D2/500 X |
| 1,327,062 | 1/1920 | Quinn | 2/207 X |
| 2,183,998 | 3/1938 | Thorman | 2/207 |
| 2,346,918 | 4/1944 | Herbranson | 2/91 |
| 2,804,626 | 9/1957 | Rossiter | 2/91 |
| 2,824,311 | 2/1958 | Barnett | 2/207 |
| 3,105,970 | 10/1963 | Herzberg | 2/207 X |
| 3,286,276 | 11/1966 | Calisch | 2/207 X |
| 3,380,076 | 4/1968 | Held | 2/207 |
| 4,654,897 | 4/1987 | Rosean | 2/207 |

FOREIGN PATENT DOCUMENTS

| | | | |
|---|---|---|---|
| 1107252 | 12/1955 | France | 2/207 |
| 2541871 | 9/1984 | France | 2/129 |
| 25850 | of 1897 | United Kingdom | 2/199 |
| 827231 | 2/1960 | United Kingdom | 2/207 |

OTHER PUBLICATIONS

Sears Midwinter Sale Catalog, 1935, Illustration B.

*Primary Examiner*—Werner H. Schroeder
*Assistant Examiner*—Sara M. Current
*Attorney, Agent, or Firm*—Leon Gilden

[57] ABSTRACT

A scarf construction is set forth wherein a triangular scarf member formed of flexible sheet-like construction configured as an isosceles triangle includes a series of buttons aligned with a bisecting line of a first apex with an opposing series of button slot apertures for receiving the buttons aligned with a bisecting line of an opposing apex corner for securement of the scarf about an individual. An alternative embodiment utilizes zippered segments spaced apart along the base of the triangular construction. A further embodiment includes a plurality of scarves, wherein a first triangular scarf member includes a plurality of pairs of button slots for securement to button pairs of a second scarf, wherein the button pairs of the second scarf are displaced relative to a positioning of the button slots to provide an elongate scarf arrangement when the two scarf portions are secured together. A further embodiment includes a scarf construction defining a pocket therewithin for receiving an inflatable bladder to provide shape and body to the scarf construction in use.

2 Claims, 4 Drawing Sheets

PRIOR ART

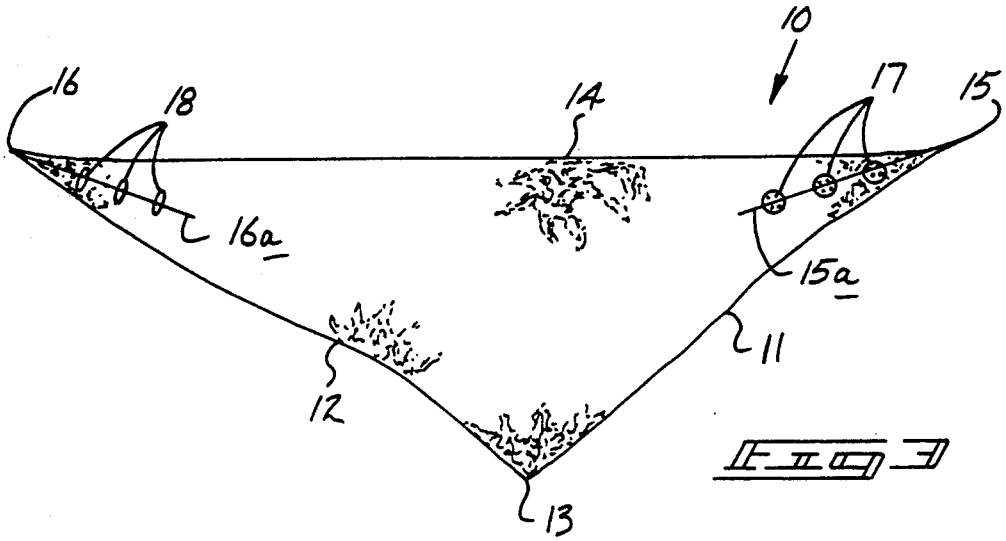
FIG 3
FIG 4
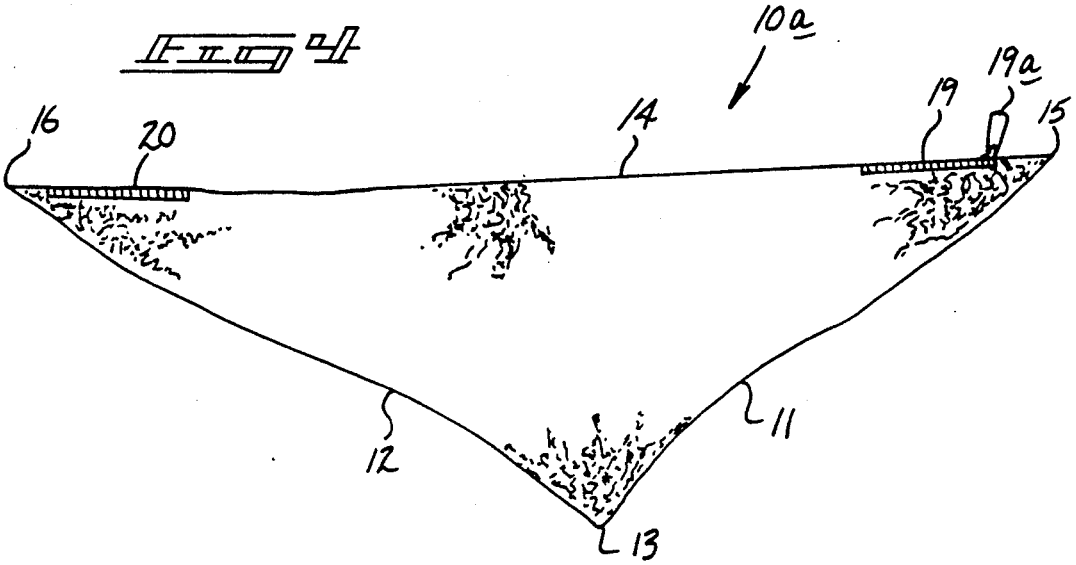

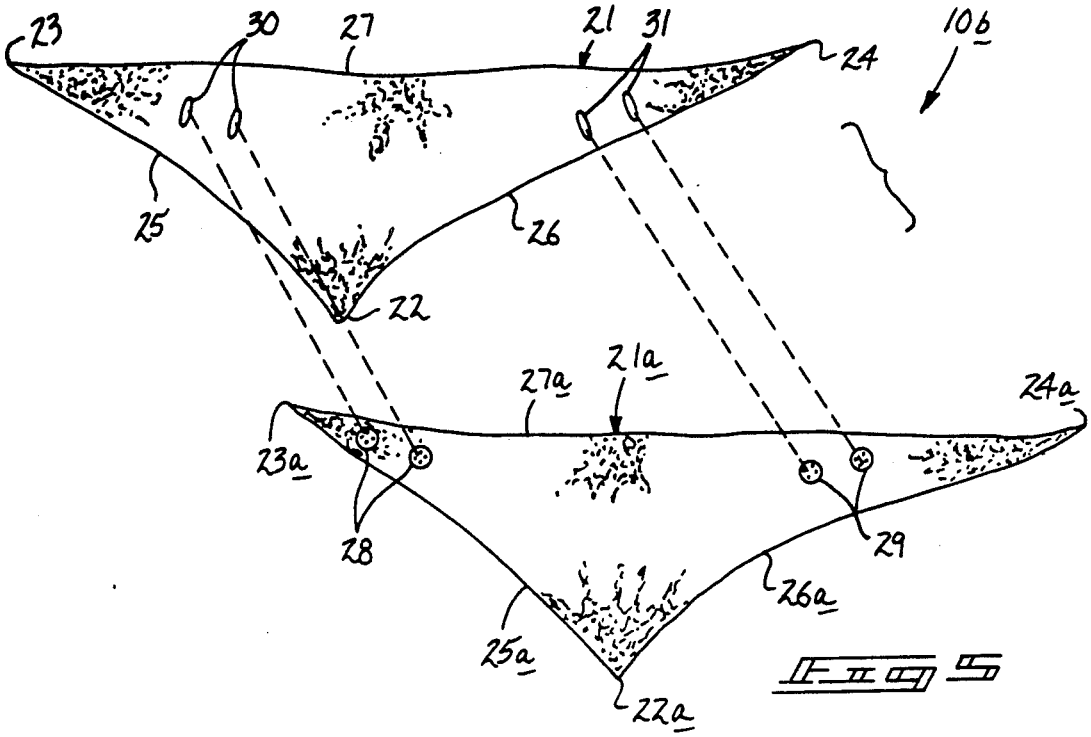
FIG 5
FIG 6
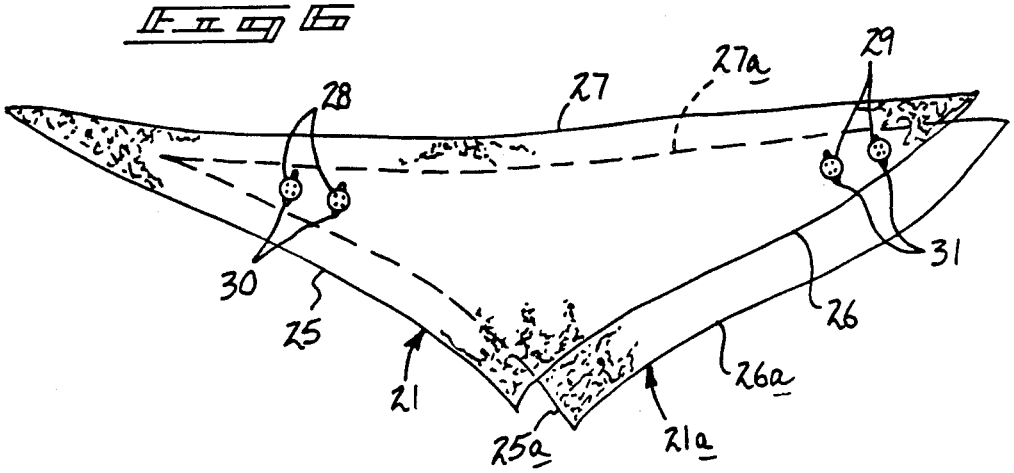

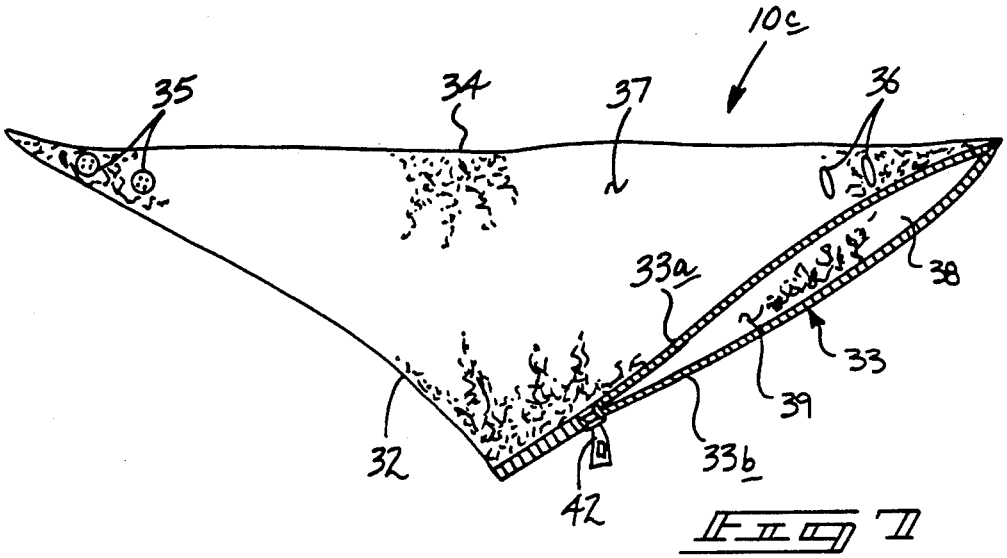
FIG 7
FIG 8
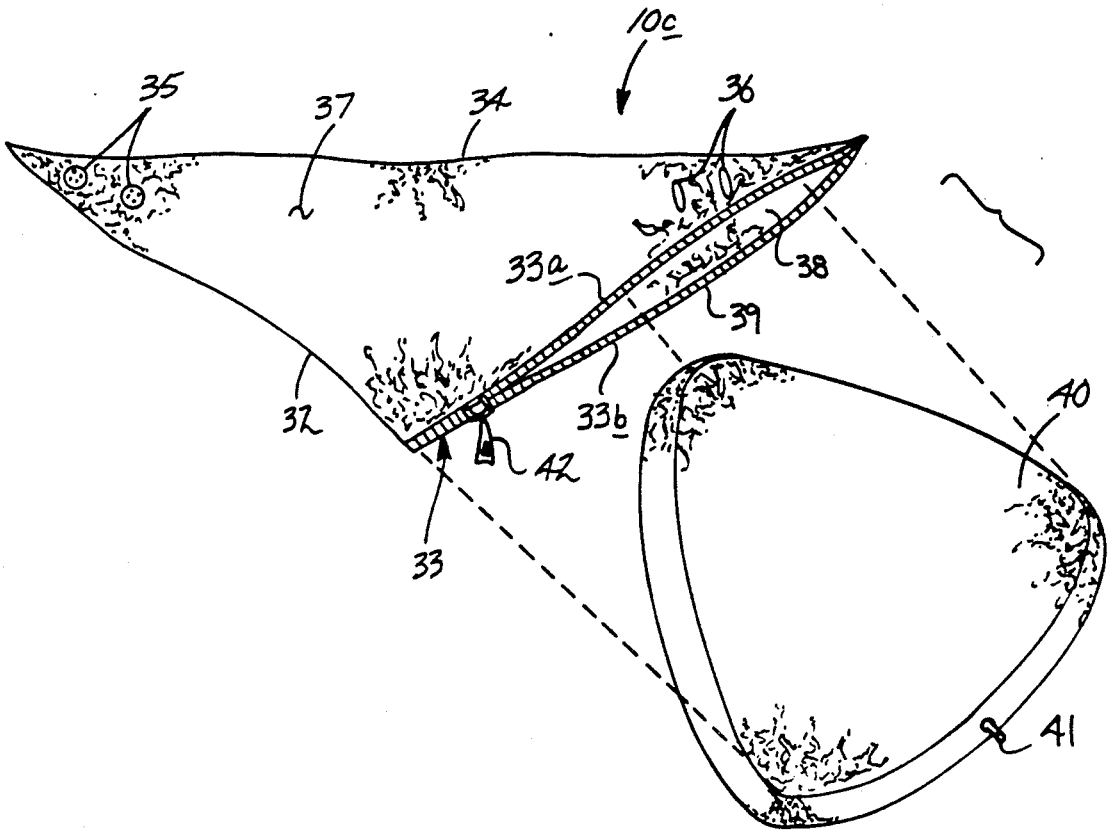

SCARF CONSTRUCTION

BACKGROUND OF THE INVENTION

1. Field of the Invention

The field of invention relates to scarf construction, and more particularly pertains to a new and improved scarf construction wherein the same utilizes various fastener arrangements for providing securement of a scarf construction in use by an individual.

2. Description of the Prior Art

Scarf constructions of various types for adornment and protection of various body portions of an individual are known in the prior art. Prior art scarf constructions have utilized fasteners to develop the securement of a scarf about itself in use by an individual. Examples include U.S. Pat. No. 3,286,276 to Calisch wherein an elongate, rectangular flexible scarf utilizes a series of buttons coextensive with a first edge is securable with button apertures coextensive with the second edge for securement of the scarf together, wherein alternative zippered end portions to secure the remote ends of the scarf are utilized.

U.S. Pat. No. 2,804,626 to Rossiter sets forth a scarf construction wherein a rectangular portion includes a plurality of downwardly extending members that include associating fasteners for securement of the scarf about a torso portion of a body member of an individual.

U.S. Pat. No. 4,654,897 to Rosaen sets forth a scarf construction wherein a generally elongate, retangular scarf includes opposed hook and loop fasteners for securement of the scarf together, wherein the hook and loop fasteners are positioned at remote ends of the elongate, rectangular scarf.

U.S. Pat. No. 3,380,076 to Held provides a scarf construction utilizing various hook members and loops for securement of various side edges of the scarf in various configurations together, wherein the rectangular scarf presents a geometric, multiple of potential scarf configurations to be used by an individual.

U.S. Pat. No. Des. 121,135 to Wittl sets forth a scarf construction including a plurality of legs extending from a medial portion for securement about an individual in use.

As such, it may be appreciated that there is a continuing need for a new and improved scarf construction wherein the same addresses both the problems of ease of use, as well as effectiveness in construction, and in this respect, the present invention substantially fulfills this need.

SUMMARY OF THE INVENTION

In view of the foregoing disadvantages inherent in the known types of scarf constructions now present in the prior art, the present invention provides a scarf construction wherein the same utilizes various fasteners for a single or multiple portion of scarf segments securable together for fastening about an individual in use. As such, the general purpose of the present invention, which will be described subsequently in greater detail, is to provide a new and improved scarf construction which has all the advantages of the prior art scarf constructions and none of the disadvantages.

To attain this, the present invention includes a scarf construction wherein a triangular scarf member formed of flexible sheet-like construction configured as an isosceles triangle includes a series of buttons aligned with a bisecting line of a first apex with an opposing series of button slot apertures for receiving the buttons aligned with a bisecting line of an opposing apex corner for securement of the scarf about an individual. An alternative embodiment utilizes zippered segments spaced apart along the base of the triangular construction. A further embodiment includes a plurality of scarves, wherein a first triangular scarf member includes a plurality of pairs of button slots for securement to button pairs of a second scarf, wherein the button pairs of the second scarf displaced relative to a positioning of the button slots to provide an elongate scarf arrangement when the two scarf portions are secured together. A further embodiment includes a scarf construction defining a pocket therewithin for receiving an inflatable bladder to provide shape and body to the scarf construction in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scarf construction which has all the advantages of the prior art scarf construction and none of the disadvantages.

It is another object of the present invention to provide a new and improved scarf construction which may be easily and efficiently manufactured and marketed.

It is a further object of the present invention to provide a new and improved scarf construction which is of a durable and reliable construction.

An even further object of the present invention is to provide a new and improved scarf construction which is susceptible of a low cost of manufacture with regard to both materials and labor, and which accordingly is then susceptible of low prices of sale to the consuming public, thereby making such scarf construction economically available to the buying public.

Still yet another object of the present invention is to provide a new and improved scarf construction which provides in the apparatuses and methods of the prior art some of the advantages thereof, while simultaneously overcoming some of the disadvantages normally associated therewith.

Still another object of the present invention is to provide a new and improved scarf construction wherein the same enables an individual scarf utilizing various fastener members for securement about an individual, wherein the scarf is generally of an isosceles triangular construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top orthographic view of a scarf construction of the instant invention.

FIG. 4 is a top orthographic view of a further scarf construction of the instant invention.

FIG. 5 is a yet further scarf construction utilized by the instant invention.

FIG. 6 is a top orthographic view of the scarf construction of FIG. 5 in an assembled configuration.

FIG. 7 is a further modified scarf construction of the instant invention.

FIG. 8 is a top orthographic view of the scarf construction of FIG. 7 in association with an inflatable bladder.

DESCRIPTION OF THE PREFERRED EMBODIMENT

Figure 1:
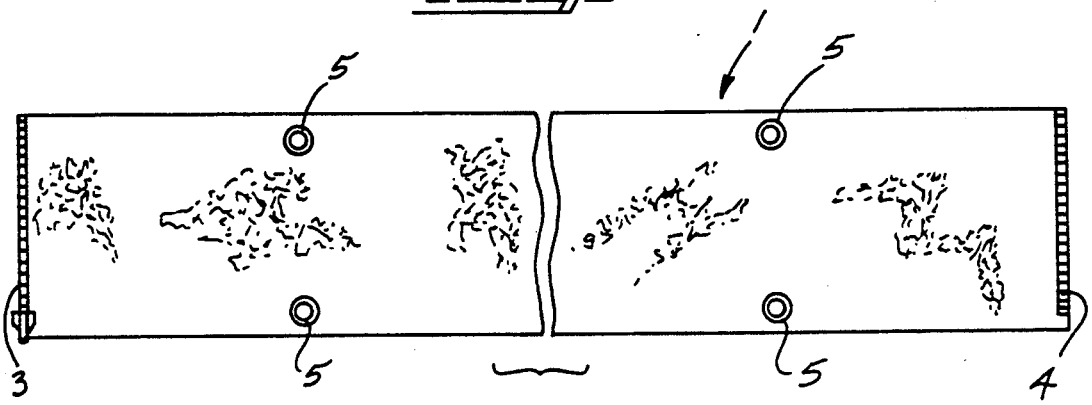
FIG. 1 is a top orthographic view of a prior art scarf construction.

With reference now to the drawings, and in particular to FIGS. 1 to 8 thereof, a new and improved scarf construction embodying the principles and concepts of the prevent invention and generally designated by the reference numerals 10, 10*a*, 10*b*, and 10*c* will be described.

Figure 2:
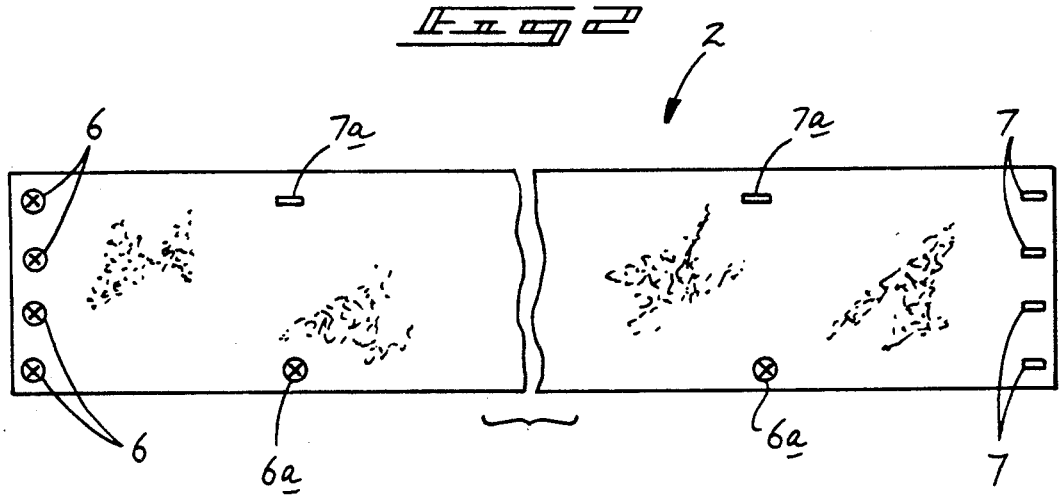
PRIOR ART Fig 2
FIG. 2 is a top orthographic view of a further example of a prior art scarf construction.

More specifically, the scarf construction of the instant invention defines an improvement over the prior art, as illustrated in FIGS. 1 and 2, wherein an elongate scarf 1 utilizes a first zipper segment 3 spaced from a second zippered segment 4 on opposed end edges of the rectangular scarf 1, with snap fasteners 5 to enable securement of opposed side edges of the scarf together. The scarf construction 2 includes buttons 6 in association with button slots 7 for securement of end edges of the rectangular scarf together with side edge buttons 6*a* for securement to end slots 7*a* to enable securement of various sides of the scarf together.

More specifically, the scarf construction 10, as illustrated in FIGS. 3 and 4, essentially comprises a sheet-like triangular member formed of interwoven fabric or of polymeric film defined as an isosceles triangle, with a first end edge 11 of equal length to a second end edge 12 defining a first apex and inclined angle at their intersection, with a base 14 spaced from the first apex 13 with a second apex 15 defined between the convergence of the base end edge 14 and the first end edge 11, and third apex 16 defined at the intersection of the base end edge 14 and the second end edge 12. A series of buttons 17 is aligned adjacent the second apex 15 in spaced equal intervals along a first bisecting line 15*a* bisecting an included angle defined by the second apex 15, with a series of button slots 18 spaced at equal intervals to that defined by the buttons 17 and aligned along a second bisecting line 16*a* bisecting the included angle defined at the third apex 16. Overfolding and securement of the second and third apex portions and their associated buttons 17 and button slots 18 enable ease of securement of the scarf 10 about an individual. A second scarf construction 10*a*, as illustrated in FIG. 4, wherein a similar isosceles triangle configuration scarf is provided with a first zipper segment 19 spaced at a position adjacent the second apex corner 15 along the base end edge 14 a predetermined distance, wherein the first zipper segment is spaced from the second apex 15, wherein similarly a second zippered segment 20 of equal length to the first zippered segment 19 is spaced from a third apex corner 16 along the base end edge 14 to enable securement of the first and second zippered segments together to join the portions of the base 14 at the zipper segments utilizing the zipper slide handle in association with a conventional zipper side to secure the zipper segments together.

A third scarf construction 10*b*, as illustrated in FIGS. 5 and 6, wherein a first scarf member 21 of an isosceles triangular construction is selectively securable to a second scarf member 21*a*. The first scarf member includes a first apex corner formed as an intersection of a first and second side member 25 and 26 respectively of equal length, with a third side member 27 defining a base member, with a second apex corner 23 defined as the intersection of the first and third side members and a third apex corner 24 formed as the intersection of the third and first side members 27 and 25 respectively. The construction of the second scarf member 21*a* in its external configuration with a first apex corner 22*a*, a second apex corner 23*a*, a third apex corner 24*a*, a respective first, second, and third side 25*a*, 26*a*, and 27*a* defining a configuration equal to that of the first scarf member 21. The second member 21*a* includes a first button pair 28 spaced a predetermined distance from the second apex corner 23*a*, and the second button pair 29 spaced a predetermined distance from the third apex corner 24*a*. These button pairs 28 and 29 are securable to associated first and second button slot pairs 30 and 31, wherein the first button slot pair 30 is spaced from the second apex corner 23 a further predetermined distance greater than that defined by the predetermined distance of the button pair 28 from its associated apex corner 23*a*, wherein the spacing of the second button slot pair 31 to its associated third apex corner 24 defines a distance less than that defined by the spacing of the second button pair 29 to its associated third apex corner 24*a*. This offset positioning of the button pairs relative to the button slots provides a structures as set forth in FIG. 6 defining an elongate scarf construction that is of an essential double thickness, but defines a length somewhat greater than that of each individual scarf member 21 or 21*a* to provide durability, as well as enhancement of clothing worn by an individual.

FIG. 7 illustrates a fourth scarf construction 10*c*, also of an isosceles triangular configuration, but of a double layered construction defined by a top wall 37 overlying a bottom wall 38 coextensively therewith. Each of the thusly formed walls are secured together at a first side edge 32 defining a first length equal to a second side edge 33 that is selectively securable together defined by a top zipper segment 33*a* formed coextensively with a top edge of the top wall 37, and a bottom zipper segment 33*b* formed coextensively with the edge of the bottom wall 38 that each define the second side edge 33 in a secured configuration when the zipper segments 33*a* and 33*b* are secured together by a common zipper slide 42 and handle. A third side base edge 34 defines a continuous seam between the top and bottom walls 37 and 38, as does the second side edge 33, to define a pocket 39 between the top and bottom walls 37 and 38. A button slot pair 36 is formed adjacent the intersection of the third and second side edges equally spaced between the aforenoted side edges, with a button pair 35 equally spaced between the side edges 32 and 34 at a spacing from the apex intersection in equal distance to that defined by the button slot pair 36 in a similar manner as the positioning of the button slots and buttons of the scarf construction, as illustrated in FIG. 3. A triangular pneumatic bladder 40, including a valve 41, is selectively inflatable to provide various degrees of firmness to the scarf construction 10*c* when the bladder is inserted within the pocket 39 and the zipper segments 33*a* and 33*b* are secured together by use of the zipper slide 42. The pneumatic bladder is generally not inflated to a great degree, but sufficiently to provide a form retaining configuration to the scarf construction in use to impart a predetermined geometric integrity to the scarf construction in use.

As such, the use and construction of the scarf construction, as illustrated and discussed above, should be apparent from the above description and accordingly no further discussion relative to ther manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restorted to, falling within the scope of the invention.

What is claimed as being new and desired to be protected by Letters Patent of the United States is as follows:

1. A scarf construction comprising, a triangular sheet member defined by a first edge, a second edge, and a third edge, and a first apex corner defined by an intersection of the first and second edges, and second apex corner defined by an intersection of the second and third edges, and a third apex corner defined by an intersection of the first and third edges, and a first fastener means integrally mounted on the sheet member adjacent the second apex corner at a first distance spaced therefrom, and a second fastener means integrally mounted on the sheet member adjacent the third apex corner spaced and a second distance therefrom wherein the first fastener means and the second fastener means are selectively securable together, and wherein the first distance and the second distance are equal, and the first edge and the second edge are of equal length, wherein the triangular sheet member is defined as an isosceles triangular sheet member, and wherein a first bisecting line bisecting an included angle defined by an intersection of the second and third edges, and a further bisecting line bisecting an included angle defined by an intersection of the first and third edges, and the first fastener means are defined as a plurality of buttons, and the second fastener means are defined as a plurality of button slots, and the buttons are arranged along the bisecting line, and the button slots are arranged at equal intervals along the further bisecting line, and wherein the triangular sheet member includes an upper sheet and a lower sheet, and wherein the first edge defines a coextensive first seam between the upper and lower sheets, and the third edge defines a third coextensive seam between the upper and lower sheets, and the second edge includes an upper edge and a lower edge, the upper edge including a first zipper segment coextensive with the upper edge, and the lower edge including a second zipper segment coextensive with the lower zipper edge, the first and second zipper segments selectively securable together and wherein the upper and lower sheets define a pocket therebetween with an opening defined between the first and second zipper segments, and further including a pneumatic bladder selectively positionable and receivable within the pocket, and the bladder further including a valve to enable selective inflation of the bladder.

2. A scarf construction comprising, a triangular sheet member defined by a first edge, a second edge, and a third edge, and a first apex corner defined by an intersection of the first and second edges, and a second apex corner defined by an intersection of the second and third edges, and a third apex corner defined by an intersection of the first and third edges, and a first fastener means integrally mounted on the sheet member adjacent the second apex corner at a first distance spaced therefrom, and a second fastener means integrally mounted on the sheet member adjacent the third apex corner spaced and a second distance therefrom, wherein the first fastener means and the second fastener means are selectively securable together, and wherein the first distance and the second distance are equal, and the first edge and the second edge are of equal length, wherein the triangular sheet member is defined as an isosceles triangular sheet member, and including a further triangular sheet member of equal configuration to the triangular sheet member, and wherein the further triangular sheet member includes a first and second button pair mounted thereon, the first button pair mounted adjacent the third apex corner a predetermined distance and the second button pair mounted on the sheet member spaced from the second apex corner a further predetermined distance, and the sheet member including a first button slot pair mounted on the sheet member adjacent the third apex corner of the sheet member a distance greater than said predetermined distance defined by the first button pair, and a second button slot pair spaced from the second corner a distance less than said further predetermined distance defined by spacing of the second button pair to enable securement of the sheet member relative to the further sheet member.

* * * * *